US009726394B2

(12) United States Patent
Buchanan

(10) Patent No.: US 9,726,394 B2
(45) Date of Patent: Aug. 8, 2017

(54) UNDER CABINET AIR DUCTING KIT

(71) Applicant: James Buchanan, Lyndeborough, NH (US)

(72) Inventor: James Buchanan, Lyndeborough, NH (US)

( * ) Notice: Subject to any disclaimer, the term of this patent is extended or adjusted under 35 U.S.C. 154(b) by 482 days.

(21) Appl. No.: 13/899,478

(22) Filed: May 21, 2013

(65) Prior Publication Data

US 2014/0345737 A1 Nov. 27, 2014

(51) Int. Cl.
*F24F 13/02* (2006.01)

(52) U.S. Cl.
CPC ..... *F24F 13/0218* (2013.01); *F24F 13/0209* (2013.01)

(58) Field of Classification Search
CPC ..... F24F 13/0209; F24F 13/0218; F24F 13/0227; F24F 13/06
USPC ..... 454/21, 246; 138/109
See application file for complete search history.

(56) References Cited

U.S. PATENT DOCUMENTS 1,640,331 A * 8/1927 Lewis ..... F24F 7/04 165/54
2,824,575 A * 2/1958 Rosen ..... F16L 37/084 138/109
3,002,443 A * 10/1961 Brandes ..... F24D 5/02 454/287
3,260,188 A * 7/1966 Person ..... F24F 13/072 454/304
4,584,986 A * 4/1986 Cannata ..... F23J 13/04 126/318
4,750,411 A * 6/1988 Eversole ..... F24F 13/0236 138/162
4,872,397 A * 10/1989 Demeter ..... F24F 1/00 236/49.5
5,095,942 A * 3/1992 Murphy ..... F16L 9/003 137/561 A
5,360,374 A * 11/1994 Wyon ..... F24F 13/0604 219/218
5,393,106 A * 2/1995 Schroeder ..... F16L 41/082 285/136.1
5,408,721 A * 4/1995 Wall ..... A47L 5/38 15/301
6,318,113 B1 * 11/2001 Levy ..... F24F 3/044 454/306
6,379,241 B1 * 4/2002 Kuo ..... F24F 13/06 454/248
6,884,159 B1 * 4/2005 Ferraud, Jr. ..... B60H 1/00592 454/119
7,022,011 B1 * 4/2006 Rickman ..... F24F 13/02 454/306

(Continued)

*Primary Examiner* — Alissa Tompkins
*Assistant Examiner* — Frances F Hamilton
(74) *Attorney, Agent, or Firm* — Duane Morris LLP

(57) ABSTRACT

This invention provides a under cabinet ducting kit comprising an under cabinet supply cover; at least two oval collars, wherein a first oval collar is connected to the under cabinet supply cover at a first end; a flexible duct hose, wherein a first end of the flexible duct hose is connected to the first oval collar at a second end, and wherein a second end of the flexible duct hose is connected to a first end of a second oval collar; a toe kick backer plate, wherein a second end of the second oval collar is connected the toe kick backer plate; and at least two metal band straps, wherein the metal band straps attach the flexible duct hose to each of the first and the second oval collars.

13 Claims, 2 Drawing Sheets

(56) References Cited

U.S. PATENT DOCUMENTS 7,140,960 B2 * 11/2006 Pilger ..... F24F 13/06 454/292
8,684,800 B2 * 4/2014 Baldal ..... B60H 1/00592 454/152
9,074,709 B2 * 7/2015 Bloom ..... F16L 21/08
2002/0006774 A1 * 1/2002 Kilburn ..... F24F 7/00 454/341
2003/0160452 A1 * 8/2003 Mattsson ..... F16L 9/003 285/424
2003/0177724 A1 * 9/2003 Botting ..... F24F 13/20 52/302.1
2005/0034407 A1 * 2/2005 Snyder ..... E04F 17/04 52/633
2006/0199505 A1 * 9/2006 Fettkether ..... F24F 13/0218 454/232
2006/0211361 A1 * 9/2006 Levy ..... F24F 13/06 454/185
2008/0022616 A1 * 1/2008 Botting ..... F24F 13/06 52/302.1
2008/0047627 A1 * 2/2008 Jungers ..... B29C 41/04 138/141
2008/0318514 A1 * 12/2008 Fettkether ..... F24F 13/0218 454/330
2009/0081941 A1 * 3/2009 Reynolds ..... F24F 13/06 454/306
2009/0286464 A1 * 11/2009 Sanchez ..... F24F 13/06 454/367
2009/0310373 A1 * 12/2009 Burkhauser ..... A01G 9/26 362/373
2010/0072746 A1 * 3/2010 Jensen ..... F16L 27/0841 285/197
2010/0201116 A1 * 8/2010 Kipker ..... F16L 21/005 285/24
2010/0201121 A1 * 8/2010 Jensen ..... F16L 41/086 285/189
2010/0300541 A1 * 12/2010 Carlay, II ..... F16K 51/02 137/1
2011/0097989 A1 * 4/2011 McQueeny, Jr. ..... A47B 13/00 454/289
2013/0316636 A1 * 11/2013 Grimes ..... F24F 13/06 454/289
2013/0324029 A1 * 12/2013 Sandman ..... F24F 13/0209 454/333

* cited by examiner

UNDER CABINET AIR DUCTING KIT

TECHNICAL FIELD

This invention relates to air duct systems. More specifically, the invention relates to a under cabinet air ducting kit.

BACKGROUND

Central heating and cooling systems use an air distribution or duct system to circulate heated or cooled air to all the conditioned rooms in a house. The efficiency of this distribution system depends on how well the ducts are sealed.

Duct systems that leak and/or do not distribute air properly throughout the home may increase heating/cooling cost and may draw dust, humidity and mold spores or other contaminants into the home.

Floor cabinets are raised slightly to create a small step-back space under the cabinet. This space is the toe kick, and it is designed to allow people to stand close to the cabinet. Toe kicks are especially common in kitchens, but they are also used underneath bathroom vanities, or with other types of custom cabinetry.

Many people utilize the toe kick without being aware of it. The toes slide into the toe kick opening automatically, and without a toe kick, people would be forced to stand in awkward positions at the counter. This can strain the neck and back, in addition to making people uncomfortable. Toe kicks allow people to balance in a comfortable position for working at the kitchen counter.

Standard toe kicks are around four and a half inches in depth and height. The toe kick is used to conceal the vent for a heating and cooling system, and the cut out hole is designed for the vent, and to fit the screen or register plate. This space under the cabinet is a wasted area and leaves enough room for dust to collect.

Installers use the cabinet base as a duct with just a toe kick register, to release the heat/air conditioning. It is an acceptable method, but it creates a heat loss by heating up the cabinet and its contents. The cabinet absorbs the heat and does not release most of it, which wastes energy. Another problem by blowing air under the cabinet is the dust and mold it creates. This is not acceptable for air quality or considered healthy.

Another problem with the existing way of ducting the toe kick is the new Energy Compliance Codes. Some towns require that a "Duct Pressure Test" be performed, which is not an easy test to pass considering it is extremely difficult to seal underneath the cabinet.

SUMMARY

This invention overcomes the disadvantages of the prior art by providing a ducting kit for under a cabinet that provides the maximum air flow into the room. The present invention provides a tight connection between the toe kick and the floor boot in order prevent mold and dust buildup. The present invention also prevents wasting energy by heating up the cabinet and its contents. Additionally, the present invention also provides a toe kick ducting system that is easy to install for both the professional and the do it yourself homeowner. The present invention further provides a toe kick ducting system that may be used to retrofit kitchen cabinets in new and existing homes. The present invention also provides a toe kick ducting system that provides the transition from duct to register for efficient circulation of airflow.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

BRIEF DESCRIPTION OF THE DRAWINGS

The invention description below refers to the accompanying drawings, of which.

DETAILED DESCRIPTION

Figure 1:
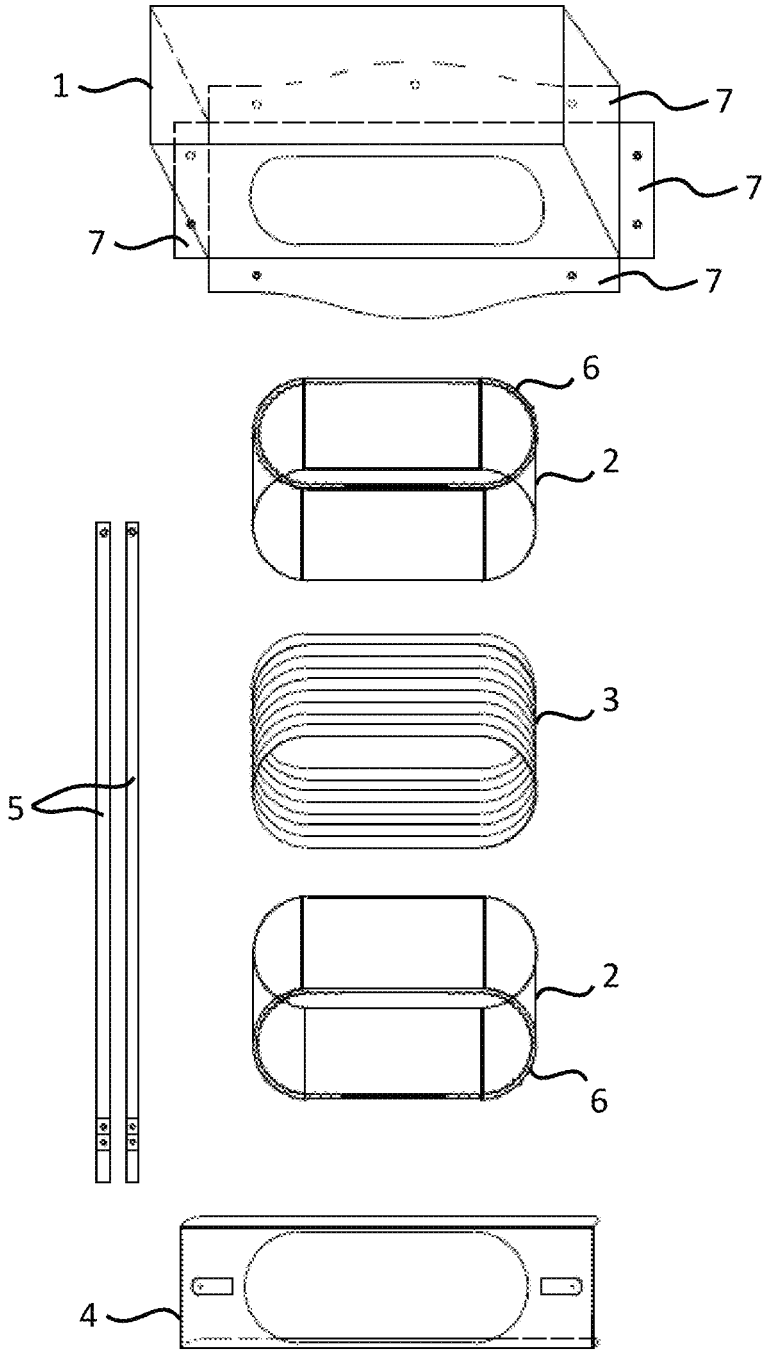
FIG. 1 is an exploded view of the toe kick ducting system.
Figure 2A:
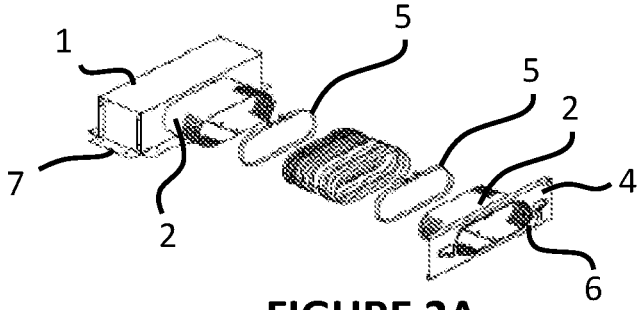
FIG. 2A is an isometric, exploded view of the ducting system shown in FIG. 1.
Figure 2B:
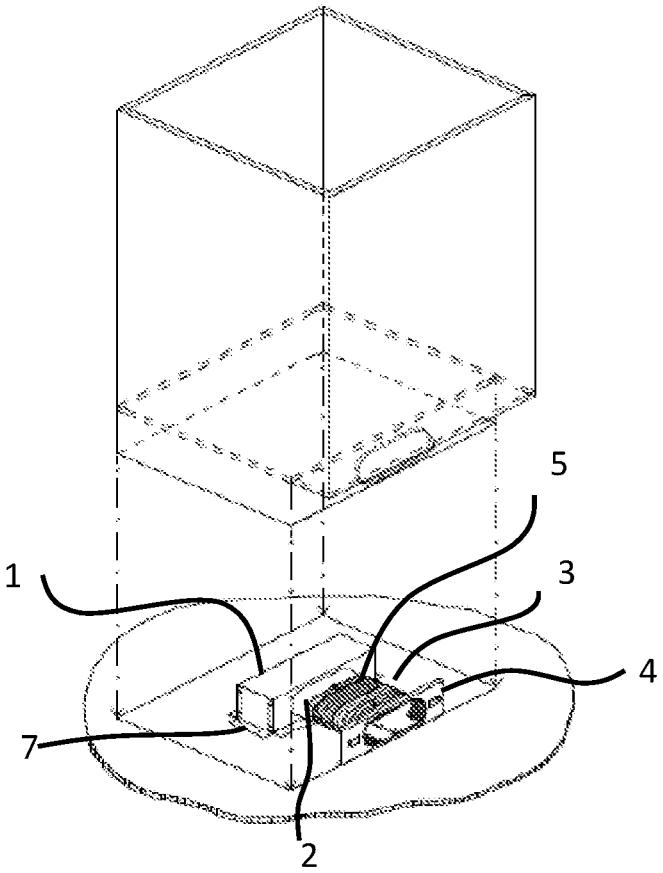
FIG. 2B depicts the ducting system of FIG. 2A with a cabinet above.

Referring to FIG. 1, the under cabinet supply cover 1 is 12"×4"×3¾" with four (4) flanges 7, one on the left, one on the right, one on the top, and one on the bottom. The front and back flanges start at 1" on either end and curve slightly like a bell curve, bringing the radius curve to 1¾" in the middle. These flanges 7 are 12" long. On the front side of the supply cover is an oval cut out for an oval collar that is dimensioned to be connected to one of the sides of the cabinet supply cover 1, i.e., one of the sides described above as being 3¾" or 4".

One end of a first oval collar 2 is connected to the under cabinet supply cover 1. This allows a flex duct hose 3 to be connected to the other end of the first oval collar. The other end of flex duct hose 3, which is 24" long, is attached to a second oval collar 2. Two metal band clamps 5 are designed to tightly attach the flex duct hose 3 to both the first and second oval collars 2.

Second oval collar 2 is attached to a toe kick backer plate 4. The toe kick backer plate 4 is attached to a cabinet base at the toe kick. The toe kick backer plate 4 has two tabs cut into the face of the plate, one on the left and one on the right. These tabs are simply bent onto the cabinet toe kick and secured with 2 screws.

There are different ways to seal the under cabinet supply cover 1 over the supply boot that is under the cabinet, including but not limited to a gasket, caulking, duct sealer, and/or glue adhesive. The under cabinet supply cover may be nailed or screwed to the floor.

Oval collar 2 has a tamping flange 6 to secure it to both the under cabinet supply cover 1 and the toe kick backer plate 4, this type of flange being capable of forming a sliding connection between the oval collar and the cover 1 or plate 4. Another way this may be done is by using dovetails or by creating a flange that can be screwed to both the under cabinet supply cover 1 and the toe kick backer plate 4.

Flexible duct hose 3 is made of foil. There are other flexible duct products, some more rigid, some are made of plastic. Flexible duct hose 3 is attached to oval collar 2 with metal straps 5. Hose clamps, tie bands, plastic ties, wire or tape may also be used.

The toe kick backer plate 4 is made of sheet metal with two finger tabs that are simply bent over the toe kick, then screwed into place. Toe kick backer plate 4 may also be attached simply by screwing straight through the toe kick into the toe kick backer plate 4.

The foregoing has been a detailed description of illustrative embodiments of the invention. Various modifications and additions can be made without departing from the spirit and scope if this invention. Each of the various embodiments described above may be combined with other described embodiments in order to provide multiple features. Furthermore, while the foregoing describes a number of separate embodiments of the apparatus and method of the present invention, what has been described herein is merely illustrative of the application of the principles of the present invention. Accordingly, this description is meant to be taken only by way of example, and not to otherwise limit the scope of this invention.

The invention claimed is:

1. A ducting kit for installation underneath a cabinet comprising:

a supply cover sized to be installed underneath the cabinet and adjacent to a toe kick of the cabinet, wherein the supply cover comprises a top side, a plurality of side walls comprising at least four side walls connected to, and orthogonal to the top side, the four side walls connected to each other and including a first side, a second side, a third side and a fourth side, each side wall having a bottom edge opposite the top side, and a plurality of floor-attaching flanges wherein one of the plurality of floor-attaching flanges is attached to the bottom edge of each of the four side walls; wherein a first flange of the plurality of floor-attaching flanges is located along the first side of the supply cover, a second flange of the plurality of floor-attaching flanges is located along the second side of the supply cover, a third flange of the plurality of floor-attaching flanges is located along the third side of the supply cover, and a fourth flange of the plurality of floor-attaching flanges is located along the fourth side of the supply cover, the first and second sides of the supply cover being located between the third and fourth sides of the supply cover, each of the first and the second flanges having a curved edge for covering a circular hole in a floor, and the supply cover further defines an oval cutout hole in a wall of one of the first and second sides;

at least two oval collars, wherein at a first end of a first oval collar, the first oval collar is to be connected to the supply cover at the oval cutout hole in the wall of one of the first and second sides, and the first end of the first oval collar comprises a curved flange sized to join with an edge of the oval cutout hole; and wherein at a second end of a second oval collar, the second oval collar comprises a curved flange;

a flexible duct hose, wherein a first end of the flexible duct hose is to be connected to the first oval collar at a second end of the first oval collar, wherein a second end of the flexible duct hose is to be connected to a first end of a second oval collar of the at least two oval collars;

a toe kick backer plate sized to be installed in the toe kick of the cabinet, wherein the toe kick backer plate defines an oval cutout hole, the toe kick backer plate is to be connected to, the curved flange of the second end of the second oval collar, the second oval collar is sized to be joined with an edge of the oval cutout hole defined by the toe kick backer plate; and at least two band straps, wherein the band straps are to attach the flexible duct hose to each of the first and the second oval collars;

wherein the supply cover and the toe kick backer plate are sized to be installed separate from each other by the at least two oval collars and the flexible duct hose; and wherein the toe kick backer plate comprises a plurality of finger tabs, each of the plurality of finger tabs defining a curved aperture, each of the plurality of finger tabs being bendable relative to the toe kick backer plate.

2. The ducting kit of claim 1 wherein each of the plurality of floor-attaching flanges is bendable in a direction away from each other and parallel to a cabinet floor.

3. The ducting kit of claim 1 wherein the oval cutout hole of the supply cover is sized to fit the first end of the first oval collar by a sliding connection with the first oval collar curved flange.

4. The ducting kit of claim 1 wherein the curved flange on the first end of the first oval collar and the curved flange end on second end of the second oval collar extends outwardly from and circumferentially about each of the respective first and second ends thereof.

5. The ducting kit of claim 1 wherein the oval cut-out hole defined by the toe kick backer plate is sized to fit the flange on the second end of the second oval collar.

6. The ducting kit of claim 1 wherein the first and the second oval collars are connected to each other by the flexible duct hose when installed.

7. The ducting kit of claim 1 wherein the first oval collar, the flexible duct hose, and the second oval collar are sized to be connected along a central axis.

8. The ducting kit of claim 1, wherein the toe kick backer plate is made of sheet metal with two D-shaped finger tabs, the finger tabs located laterally of the oval cut-out hole, and each of the two finger tabs is bendable to enable installation.

9. A system installed underneath a cabinet comprising:

a supply cover sized to be installed underneath the cabinet and adjacent to a toe kick of the cabinet, wherein the supply cover comprises a top side, four side walls connected to, and orthogonal to the top side, the four side walls connected to each other and including a first side, a second side, a third side and a fourth side, each side wall having a bottom edge opposite the top side, and a plurality of floor-attaching flanges wherein each side wall bottom edge comprises one of a plurality of floor-attaching flanges; wherein a first flange of the plurality of floor-attaching flanges is located along the first side of the supply cover, a second flange of the plurality of floor-attaching flanges is located along the second side of the supply cover, a third flange of the plurality of floor-attaching flanges is located along the third side of the supply cover, and a fourth flange of the plurality of floor-attaching flanges is located along the fourth side of the supply cover, the first and second sides of the supply cover being located between the third and fourth sides of the supply cover, each of the first and the second flanges having a curved edge for covering a circular hole in a floor, and the supply cover further defines an oval cutout hole in a wall of one of the first and second sides;

at least two oval collars, wherein a first oval collar is connected to the supply cover at a first end of the first oval collar, wherein the first end of the first oval collar comprises a curved flange that slidingly receives an edge of the oval cutout hole defined by the supply cover and wherein a second end of a second oval collar comprises a curved flange;

a flexible duct hose, wherein a first end of the flexible duct hose is connected to the first oval collar at a second end of the first oval collar, wherein a second end of the flexible duct hose is connected to a first end of the second oval collar;

a toe kick backer plate installed in the toe kick of the cabinet, wherein the toe kick backer plate defines an oval cutout hole, wherein the toe kick backer plate is connected to the second end of the second oval collar, that comprises the curved flange, the curved flange slidingly receives an edge of the oval cutout hole defined by the toe kick backer plate; and at least two band straps, wherein the band straps attach the flexible duct hose to each of the first and the second oval collars;

wherein the supply cover and the toe kick backer plate are separated from each other by the two oval collars and the flexible duct hose, and wherein the toe kick backer plate comprises a plurality of finger tabs formed within the toe kick backer plate, and each of the plurality of finger tabs being bendable relative to the toe kick backer plate.

10. The system of claim 9 wherein each of the plurality of floor-attaching flanges is bendable in a direction away from each other and parallel to a cabinet floor.

11. The system of claim 9 wherein the curved flange on the first end of the first oval collar and the curved flange on the second end of the second oval collar extends outwardly from and circumferentially about each of the respective first and second ends thereof.

12. The system of claim 9 wherein the first and the second oval collars are connected to each other by the flexible duct hose when installed.

13. The system of claim 9 wherein the first oval collar, the flexible duct hose, and the second oval collar are connected along a central axis.

* * * * *